US008989427B2

(12) United States Patent
Silvestri et al.

(10) Patent No.: US 8,989,427 B2
(45) Date of Patent: Mar. 24, 2015

(54) EARPHONES

(71) Applicant: Bose Corporation, Framingham, MA (US)

(72) Inventors: Ryan C. Silvestri, Franklin, MA (US); Jason Harlow, Watertown, MA (US); Kevin P. Annunziato, Medway, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/911,662

(22) Filed: Jun. 6, 2013

(65) Prior Publication Data

US 2014/0363040 A1 Dec. 11, 2014

(51) Int. Cl.
*H04R 1/10* (2006.01)
*H04R 1/28* (2006.01)

(52) U.S. Cl.
CPC ..... *H04R 1/1091* (2013.01); *H04R 1/1016* (2013.01); *H04R 1/2888* (2013.01); *H04R 1/1083* (2013.01); *H04R 2460/01* (2013.01); *H04R 2460/11* (2013.01)
USPC ..... 381/380; 381/322; 381/328; 381/372; 381/373; 381/345; 381/348; 381/351; 381/354; 181/151

(58) Field of Classification Search
CPC ..... H04R 1/10; H04R 1/1016; H04R 1/2811; H04R 1/2819; H04R 1/2823; H04R 1/2869; H04R 1/2873; H04R 1/2884; H04R 1/2888; H04R 25/652; H04R 25/656; H04R 2460/09; H04R 2460/11; H04R 2460/01; H04R 1/1083
USPC ..... 381/380, 328, 322, 312, 345, 182, 189, 381/351, 349, 335, 338, 346, 354, 370–374, 381/348; 181/151
See application file for complete search history.

(56) References Cited

U.S. PATENT DOCUMENTS

| | | | | |
|---|---|---|---|---|
| 5,208,868 | A | 5/1993 | Sapiejewski | |
| 6,567,524 | B1 | 5/2003 | Svean et al. | |
| 7,039,195 | B1 | 5/2006 | Svean et al. | |
| 7,317,802 | B2 | 1/2008 | Wurtz | |
| 7,916,888 | B2 | 3/2011 | Sapiejewski et al. | |
| 2008/0002835 | A1* | 1/2008 | Sapiejewski et al. | 381/71.6 |
| 2011/0058704 | A1 | 3/2011 | Harlow et al. | |
| 2012/0039500 | A1 | 2/2012 | Silvestri et al. | |
| 2013/0142375 | A1* | 6/2013 | Sung et al. | 381/373 |

FOREIGN PATENT DOCUMENTS

WO 0103470 A1 1/2001

OTHER PUBLICATIONS

International Search Report and Written Opinion dated Oct. 21, 2014 for International application No. PCT/US2014/040142.

* cited by examiner

*Primary Examiner* — Curtis Kuntz
*Assistant Examiner* — Joshua A Kaufman

(57) ABSTRACT

An earphone includes a first acoustic chamber with one or more of a reactive element and a resistive element for acoustically coupling the first acoustic chamber with an environment external to the earphone. The earphone includes an acoustic transducer and a second acoustic chamber separated from the first acoustic chamber by the acoustic transducer. A housing supports the earphone from the concha of a wearer's ear and extends the second acoustic chamber at least to an entrance of an ear canal of the wearer's ear. A port acoustically couples the first and second acoustic chambers.

25 Claims, 4 Drawing Sheets

EARPHONES

BACKGROUND

This description relates to earphones.

U.S. Pat. No. 5,208,868 discloses an apparatus for reducing pressure inside a headphone that includes a port between front and back cavities. Preferably there is a resistive element and a high compliance diaphragm.

SUMMARY

All examples and features mentioned below can be combined in any technically possible way.

In one aspect, an earphone includes a first acoustic chamber with one or more of a reactive element and a resistive element for acoustically coupling the first acoustic chamber with an environment external to the earphone. The earphone includes an acoustic transducer and a second acoustic chamber separated from the first acoustic chamber by the acoustic transducer. A housing supports the earphone from the concha of a wearer's ear and extends the second acoustic chamber at least to an entrance of an ear canal of the wearer's ear. A port acoustically couples the first and second acoustic chambers.

Embodiments may include one of the following features, or any combination thereof. There is only a single opening in the second chamber, besides an entrance to the port, which acoustically couples the second chamber to the ear canal of the wearer's ear. The second chamber does not have a pressure equalization port to connect the second chamber to the environment external to the earphone. The first acoustic chamber has a volume between about 0.1 $cm^3$ to about 3 $cm^3$. The second acoustic chamber has a volume between about 0.05 $cm^3$ to about 3 $cm^3$. The reactive element has an acoustic absolute value impedance in the range of from about $$3\times10^7\frac{\text{kg}}{m^4\times\text{sec}}$$

to about $$6\times10^8\frac{\text{kg}}{m^4\times\text{sec}}$$

at 1 kHz. The resistive element has a specific acoustic impedance in the range of from about $$3\times10^7\frac{\text{kg}}{m^4\times\text{sec}}$$

to about $$6\times10^8\frac{\text{kg}}{m^4\times\text{sec}}.$$

The port has a diameter in the range of from about 0.25 mm to about 3 mm. The port has a diameter of about 0.5 mm. The port has a length in the range of from about 0.25 mm to about 10 mm. The port has a length of about 1 mm. The port has an acoustic absolute value impedance in the range of from about $$1\times10^7\frac{\text{kg}}{m^4\times\text{sec}}$$

to about $$3\times10^8\frac{\text{kg}}{m^4\times\text{sec}}$$

at 1 kHz. A pair of earphones as described herein.

In another aspect, an earphone includes a first acoustic chamber with one or more of a reactive element and a resistive element for acoustically coupling the first acoustic chamber with an environment external to the earphone. The earphone also includes an acoustic transducer and a second acoustic chamber separated from the first acoustic chamber by the acoustic transducer. A port acoustically couples the first and second acoustic chambers. There is only a single opening in the second chamber, besides an entrance to the port, which acoustically couples the second chamber to an ear canal of a wearer's ear.

Embodiments may include one of the above and/or below features, or any combination thereof. The earphone further including a housing to support the earphone from the concha of a wearer's ear and to extend the second acoustic chamber at least to an entrance of an ear canal of the wearer's ear.

In a still further aspect, an earphone includes a first acoustic chamber with one or more of a reactive element and a resistive element for acoustically coupling the first acoustic chamber with an environment external to the earphone. The earphone further includes an acoustic transducer and a second acoustic chamber separated from the first acoustic chamber by the acoustic transducer. A housing supports the earphone from the concha of a wearer's ear and extends the second acoustic chamber at least to an entrance of an ear canal of the wearer's ear. A port acoustically couples the first and second acoustic chambers. There is only a single opening in the second chamber, besides an entrance to the port, which acoustically couples the second chamber to the ear canal of the wearer's ear.

Embodiments may include one of the above features, or any combination thereof. Other features and advantages will be apparent from the description and the claims.

DETAILED DESCRIPTION

"Earphone" as used herein refers to a device that fits around, on, or in an ear and which radiates acoustic energy into the ear canal. An earphone may include an acoustic driver to transduce audio signals to acoustic energy. An around the ear earphone uses an acoustic driver that is much larger relatively speaking than a driver used in an in-ear earphone. The substantially smaller driver of the in-ear earphone typically has much lower acoustic output capability due to a reduction in air volume displacement. As such, acoustic cancellation caused by out of phase acoustic energy radiating from both sides of a diaphragm of the driver is much more of a concern for an in-ear earphone than an around (or on) the ear earphone. While the figures and descriptions following use a single earphone, an earphone may be a single stand-alone unit or one of a pair of earphones, one for each ear. An earphone may be connected mechanically to another earphone, for example by a headband or by leads which conduct audio signals to an acoustic driver in the earphone. An earphone may include components for wirelessly receiving audio signals. Unless otherwise specified, an earphone may include components of an active noise reduction (ANR) system.

Figure 1:
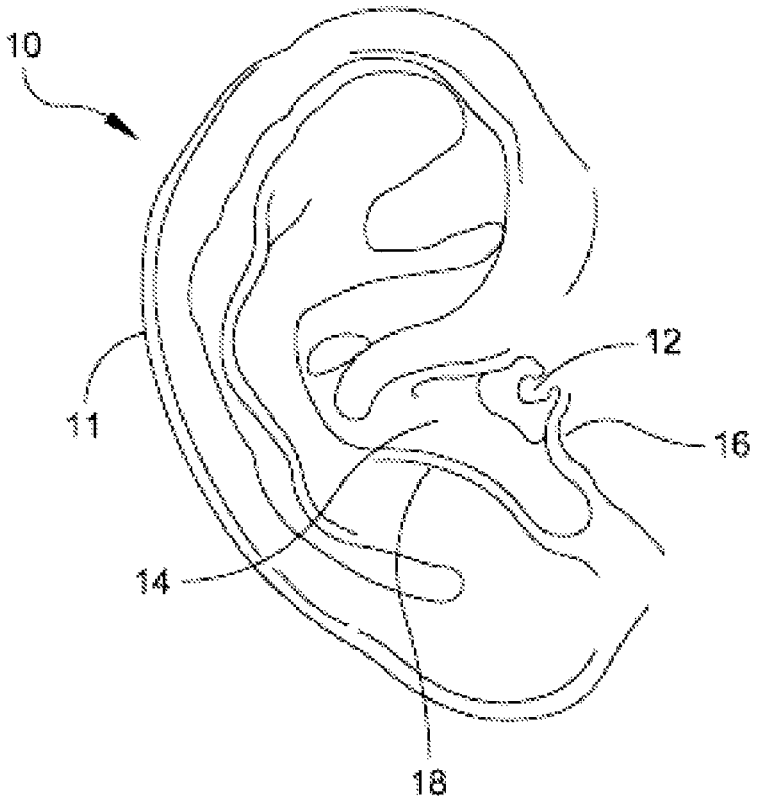
FIG. 1 shows a human ear.

As shown in FIG. 1, a human ear 10 includes an ear canal 12 which leads to the sensory organs (not shown). The pinna 11, the part of the ear outside the head, includes the concha 14, the hollow next to the ear canal 12, defined in part by the tragus 16 and anti-tragus 18. An earphone is generally designed to be worn over the pinna, in the concha, or in the ear canal.

Figure 2A:
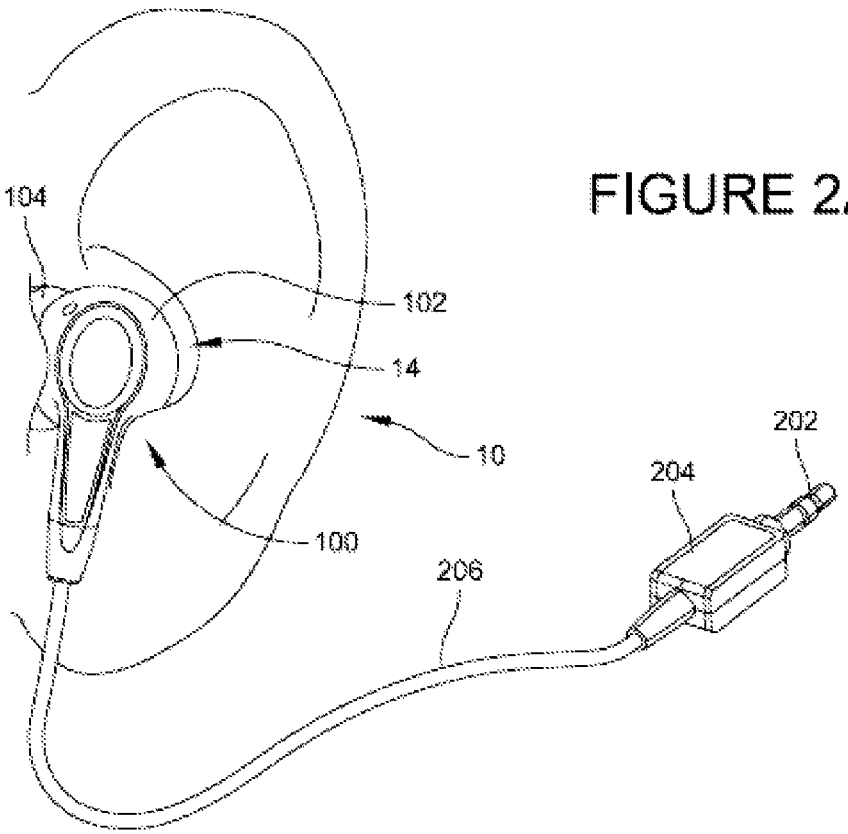
FIG. 2A is a perspective view of an earphone located in the ear.
Figure 2B:
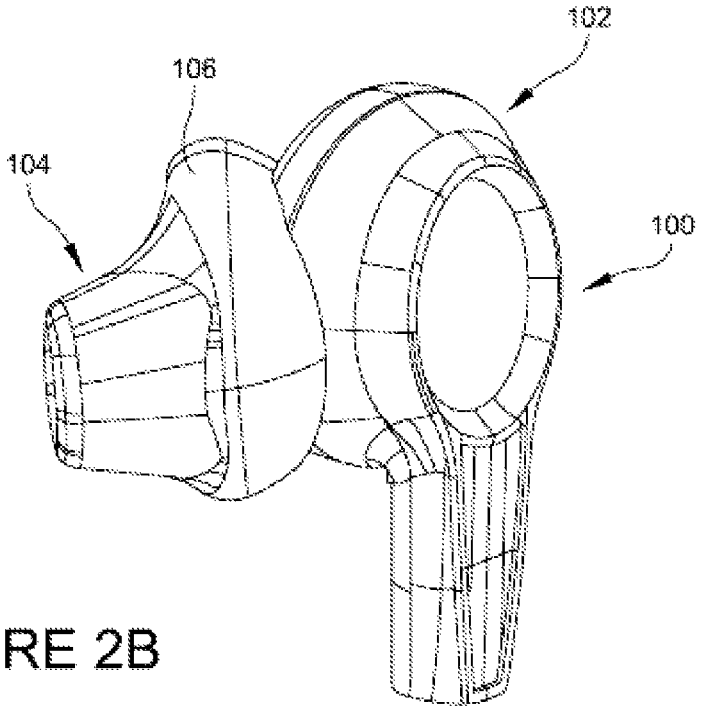
FIG. 2B is an isometric view of an earphone.

As shown in FIGS. 2A and 2B, an earphone 100 has a housing including a first region 106 designed to support the earphone from the concha 14 of the wearer's ear 10, and a second region 104 to be located at the entrance to, or in, the ear canal 12. A region 102 "floats" outside the wearer's ear between the tragus 16 and antitragus 18 (FIG. 1). (FIGS. 2A and 2B show a wearer's left ear and corresponding earphone 100. A complementary earphone may fit the right ear, not shown. In some examples, only one earphone is provided. In some examples, a left earphone and a right earphone may be provided together as a pair.) A cushion 106 (i.e. ear tip) couples the acoustic components of the earphone to the physical structure of a wearer's ear. A plug 202 connects the earphone to a source of audio signals, such as a CD player, cell phone, MP3 player, or PDA (not shown), or may have multiple plugs (not shown) allowing connection to more than one type of device at a time. A circuit housing 204 may include circuitry for modifying the audio signal, for example, by controlling its volume or providing equalization. The circuitry may also provide noise cancellation signals to the earphones. The housing 204 may also include switching circuitry, either manual or automatic, for connecting the signals output by one or another of the above mentioned sources to the earphone. A cord 206 conveys audio signals from the source to the earphones. In some examples, the signals may be communicated wirelessly, for example, using the Bluetooth™ wireless protocol, and the cord 206 would not be included. Alternatively or additionally, a wireless link may connect the circuitry with one or more of the sources.

Figure 3:
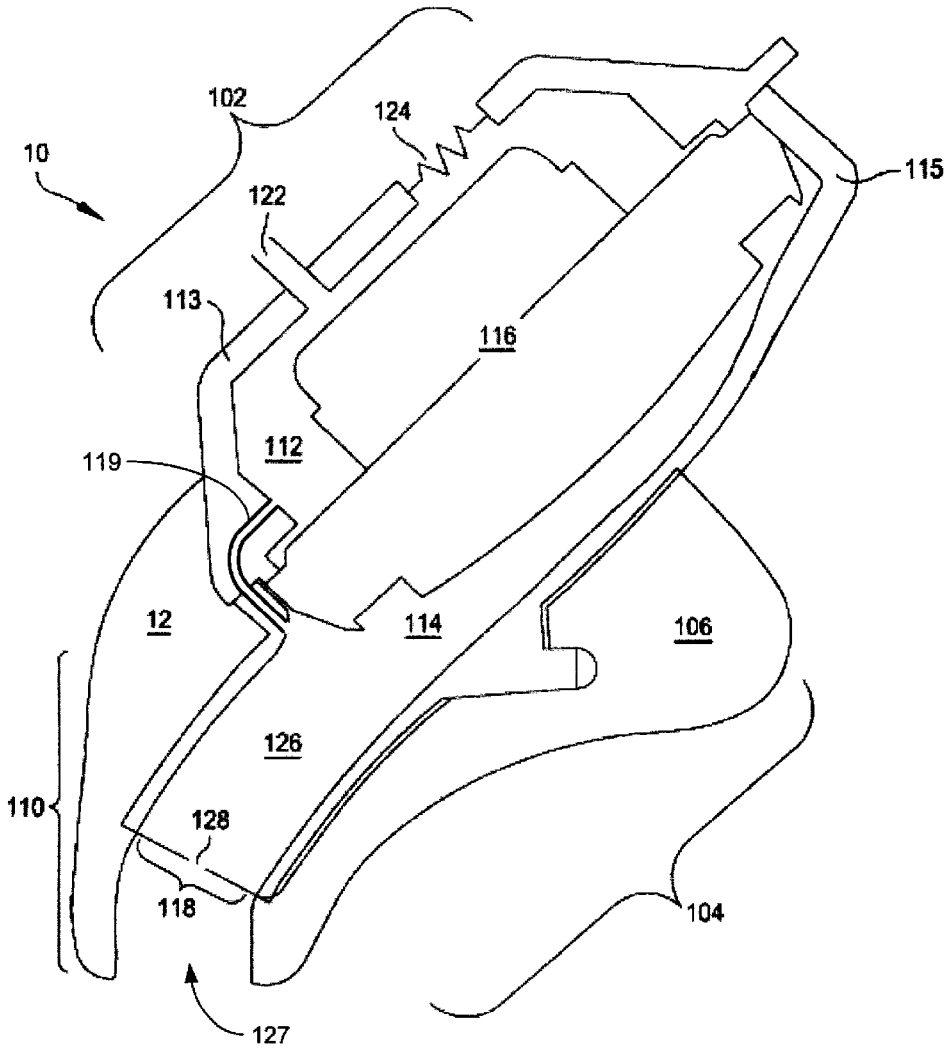
FIG. 3 is a schematic cross section of a first example of an earphone.

As shown in FIG. 3, the first region 102 of the earphone 100 includes a rear acoustic chamber 112 and a front acoustic chamber 114 defined by shells 113 and 115 of the housing, respectively, on either side of a driver (acoustic transducer) 116. In some examples, a 14.8 mm diameter driver is used. Other sizes and types of acoustic transducers could be used depending, for example, on the desired frequency response of the earphone. The driver 116 separates the front and rear acoustic chambers 114 and 112. The shell 115 of the housing extends (126) the front chamber 114 to at least the entrance to the ear canal 12, and in some embodiments into the ear canal 12, through the cushion 106 and ends at an opening 127 that may include an acoustic resistance element 118. In some examples, the resistance element 118 is located within the extended portion 126 (i.e. a nozzle), rather than at the end, as illustrated. An acoustic resistance element dissipates a proportion of acoustic energy that impinges on or passes through it. In other examples, no resistance element is included, but a screen may be used in its place to prevent debris from entering the front chamber 114. The front chamber 114 does not have a pressure equalization (PEQ) port to connect the chamber 114 to an environment external to the earphone. A PEQ port can be a source for a leak and thus a path for acoustic noise to enter the headphone.

A port 119 acoustically couples the front acoustic chamber 114 and the rear acoustic chamber 112. The port 119 serves to relieve air pressure that could be built up within the ear canal 12 and front chamber 114 when (a) the earphone 100 is inserted into or removed from the ear 10, (b) a person wearing the earphone 100 experiences shock or vibration, or (c) the earphone 100 is struck or repositioned while being worn. The port 119 preferably has a diameter of between about 0.25 mm to about 3 mm, and more preferably has a diameter of about 0.5 mm. The port 119 preferably has a length of between about 0.25 mm to about 10 mm, and more preferably has a length of about 1 mm.

The amount of passive attenuation that can be provided by a ported earphone is often limited by the acoustic impedance through the ports. Generally, more impedance is preferable. However, certain port geometry is often needed in order to have proper system performance. Ports are used to improve acoustic output, equalize audio response and provide a venting path during overpressure events. Impedance may be changed in a number of ways, some of which are related. Impedance is frequency dependent, and it may be preferable to increase impedance over a range of frequencies and/or reduce the impedance at another range of frequencies. The impedance has two components: a resistive component (DC flow resistance R) and a reactive or mass component $j\omega M$, where $\omega$ is the frequency, $$M = \frac{\rho l}{A}.$$

M is the acoustic mass, l is the length of the port, A is the cross-sectional area of the port, and $\rho$ is the density of air (which if actual measurement is difficult or impossible, may be assumed to be 1.2). The total impedance can be calculated at a specific frequency of interest by determining the magnitude or absolute value of the acoustic impedance $|z|$.

The port 119 preferably has an absolute value $|z|$ acoustic impedance of between about of $$1\times10^{7}\,\frac{\text{kg}}{m^4\times\text{sec}}$$

to about $$3\times10^{8}\,\frac{\text{kg}}{m^4\times\text{sec}}$$

at 1 kHz and more preferably has an absolute value $|z|$ acoustic impedance of about $$4\times10^{7}\,\frac{\text{kg}}{m^4\times\text{sec}}$$

at 1 KHz. The port 119 preferably has an absolute value $|z|$ acoustic impedance of between about of $$6\times10^{5}\frac{\text{kg}}{m^4\times\text{sec}}$$

to about $$2\times10^{8}\frac{\text{kg}}{m^4\times\text{sec}}$$

at 10 Hz and more preferably has an absolute value |z| acoustic impedance of about $$1.2\times10^{7}\frac{\text{kg}}{m^4\times\text{sec}}$$

at 10 Hz.

The primary purpose of the port 119 is to avoid an overpressure condition when, e.g., the earphone 100 is inserted into or removed from the user's ear 10, or during use of the earphone. Pressure built up in the front acoustic chamber 114 escapes to the rear acoustic chamber 112 via the port 119, and from there to the environment via back cavity ports 122 and 124, mainly the mass port 122 (discussed in more detail below). Additionally, the port 119 can be used to provide a fixed amount of leakage that acts in parallel with other leakage that may be present. This helps to standardize response across individuals. Adding the port 119 makes a tradeoff between some loss in low frequency output and more repeatable overall performance. The port 119 provides substantially the same passive attenuation as completely blocking a typical front chamber PEQ port with similar architecture. It was expected that adding the port 119 would cause a loss in low frequency output (e.g. in the frequency band of about 20-100 Hz) due to front-to-back self-cancellation of signals from the driver 116, but surprisingly this did not happen. The port 119 in series with the rear cavity ports 122 and 124 provides a higher impedance venting leak path compared with using a traditional front chamber PEQ instead of the port 119. Surprisingly, however, it was found that this higher impedance results in a more linear behavior during pressure equalization events which reduces the negative impact of the higher impedance.

The rear chamber 112 is sealed around the back side of the driver 116 by the shell 113 except that the rear chamber 112 includes one or both of a reactive element, such as a port (also referred to as a mass port) 122, and a resistive element, which may also be formed as a port 124. The reactive element 122 and the resistive element acoustically couple the rear acoustic chamber 112 with an environment external to the earphone, thereby relieving the air pressure mentioned above. U.S. Pat. No. 6,831,984 describes the use of parallel reactive and resistive ports in a headphone device, and is incorporated here by reference. Although we refer to ports as reactive or resistive, in practice any port will have both reactive and resistive effects. The term used to describe a given port indicates which effect is dominant. A reactive port like the port 122 is, for example, a tube-shaped opening in what may otherwise be a sealed acoustic chamber, in this case rear chamber 112. A resistive element like the port 124 is, for example, a small opening in the wall of an acoustic chamber covered by a material providing an acoustical resistance, for example, a wire or fabric screen that allows some air and acoustic energy to pass through the wall of the chamber.

The reactive element 122 preferably has an absolute value acoustic impedance |z| in the range of from about $$3\times10^{7}\frac{\text{kg}}{m^4\times\text{sec}}$$

to about $$6\times10^{8}\frac{\text{kg}}{m^4\times\text{sec}}$$

at 1 kHz, and more preferably about $$1.5\times10^{8}\frac{\text{kg}}{m^4\times\text{sec}}.$$

The reactive element 122 preferably has an absolute value acoustic impedance |z| in the range of from about $$1\times10^{6}\frac{\text{kg}}{m^4\times\text{sec}}$$

to about $$2\times10^{8}\frac{\text{kg}}{m^4\times\text{sec}}$$

at 10 Hz, and more preferably about $$1.1\times10^{7}\frac{\text{kg}}{m^4\times\text{sec}}.$$

The resistive element 124 preferably has a specific acoustic impedance in the range of from about $$3\times10^{7}\frac{\text{kg}}{m^4\times\text{sec}}$$

to about $$6\times10^{8}\frac{\text{kg}}{m^4\times\text{sec}},$$

and more preferably about $$1.15\times10^{8}\frac{\text{kg}}{m^4\times\text{sec}}.$$

The reactive element 122 preferably has a diameter of between about 0.5 mm to about 2 mm, and more preferably has a diameter of about 1 mm. The reactive element 122 preferably has a length of between about 5 mm to about 25 mm, and more preferably has a length of about 15 mm. The resistive element 124 preferably has a diameter of about 1.7 mm and a length of preferably about 1 mm covered with a 260 rayl resistive material (e.g. cloth). These dimensions provide both the acoustic properties desired of the reactive port 122, and an escape path for the pressure built up in the front chamber 114 and transferred to the rear chamber 112 by the port 119. The total absolute value impedance from the front chamber 114 through the port 119 and out the back chamber ports 122 and 124 is preferably less than about $$1\times10^{8}\frac{\text{kg}}{m^{4}\times\text{sec}}$$

at 10 Hz. The ports 122 and 124 provide porting from the rear acoustic chamber 112 to an environment external to the earphone. Furthermore, in order to receive a meaningful benefit in terms of passive attenuation when using a front to back port 119 in a ported system, the ratio of the impedance of the ports 122 and 124 to the impedance of the port 119 is preferably greater than 0.25 and more preferably around 1.6 at 1 kHz.

For an ANR earphone two functions (of many) of the ports 119, 122 and 124 are to increase the output of the system (improves active noise reduction) and provide pressure equalization. In addition, it is desirable to maximize the impedance of these ports at frequencies that can improve the total system noise reduction. At certain frequencies (e.g. at low frequency) it may be preferable for the impedance to be low for venting pressure or increasing low frequency output, and at certain other frequencies (e.g. at 1 kHz) it may be preferable for the impedance to be high in order to maximize passive attenuation. Ports allow this to occur as they can have both a resistive DC component and a reactive frequency dependent component depending upon their design.

Each of the cushion 106, cavities 112 and 114, driver 116, damper 118, port 119, and elements 122 and 124 have acoustic properties that may affect the performance of the earphone 100. These properties may be adjusted to achieve a desired frequency response for the earphone. Additional elements, such as active or passive equalization circuitry, may also be used to adjust the frequency response. The rear chamber 112 preferably has a volume of between about 0.1 $cm^3$ to about 3.0 $cm^3$, and more preferably has a volume of about 0.5 $cm^3$ (this volume includes a volume behind a diaphragm of the driver 116 (inside the transducer), but does not include a volume occupied by metal, pcb, plastic or solder). Excluding the driver, the front chamber 114 preferably has a volume of between about 0.05 $cm^3$ to about 3 $cm^3$, and more preferably has a volume of about 0.25 $cm^3$.

The reactive port 122 resonates with the back chamber volume. In some examples, the reactive port 122 and the resistive port 124 provide acoustical reactance and acoustical resistance in parallel, meaning that they each independently couple the rear chamber 112 to free space. In contrast, reactance and resistance can be provided in series in a single pathway, for example, by placing a resistive element such as a wire mesh screen inside the tube of a reactive port. In some examples, a parallel resistive port is made from an 80×700 Dutch twill wire cloth, for example, that available from Cleveland Wire of Cleveland, Ohio, and has a diameter of about 1.7 mm. Parallel reactive and resistive elements, embodied as a parallel reactive port and resistive port, provides increased low frequency response compared to an embodiment using a series reactive and resistive elements. The parallel resistance does not substantially attenuate the low frequency output while the series resistance does. Using a small rear cavity with parallel ports allows the earphone to have improved low frequency output and a desired balance between low frequency and high frequency output.

Some or all of the elements described above can be used in combination to achieve a particular frequency response (non-electronically). In some examples, additional frequency response shaping may be used to further tune sound reproduction of the earphones. One way to accomplish this is with passive electrical equalization using circuitry. Such circuitry can be housed in-line with the earphones, for example, inside the circuit housing 204 (FIG. 2A). If active noise reduction circuitry or wireless audio circuitry is present, such powered circuits may be used to provide active equalization.

Figure 4:
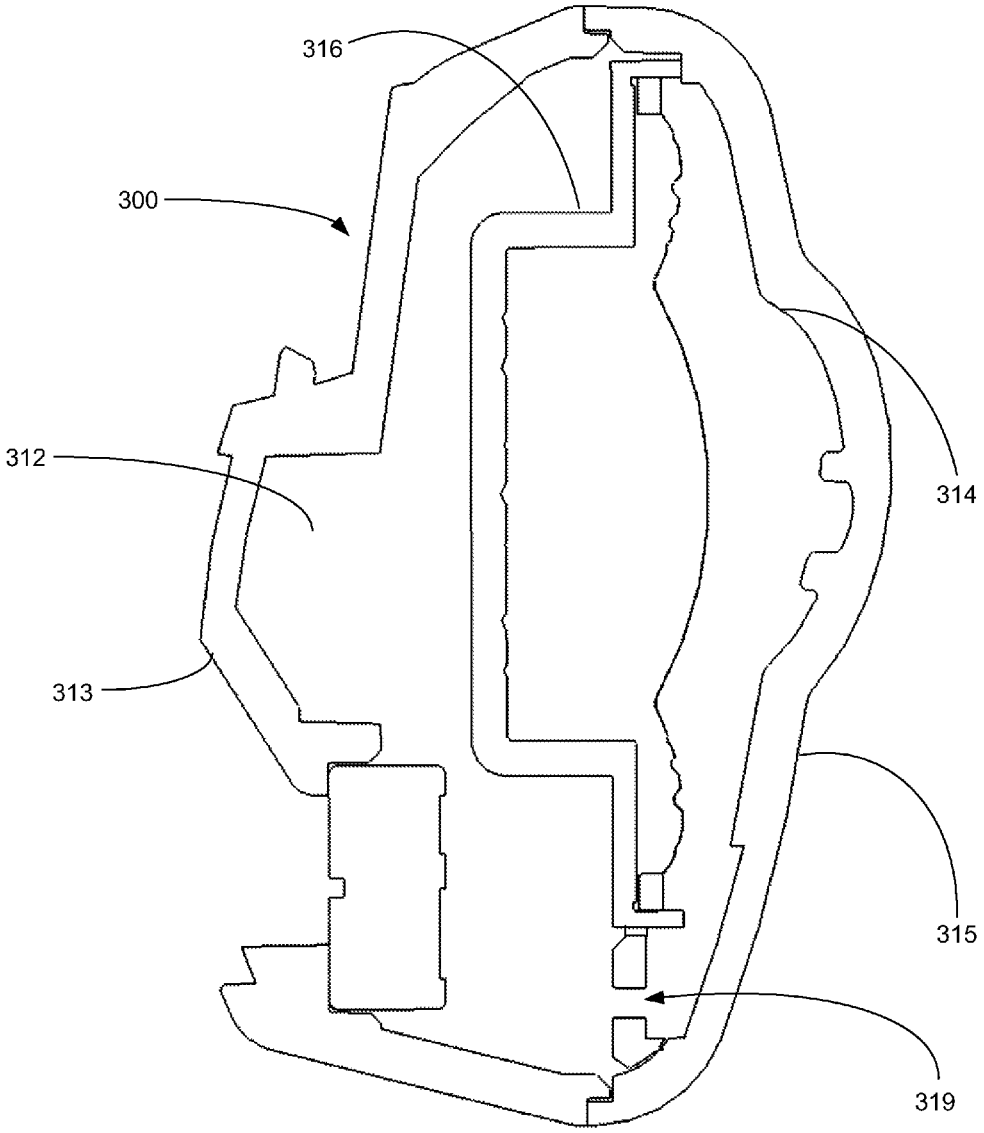
FIG. 4 is a schematic cross section of a portion of a second example of an earphone.

In FIG. 4, another example of an earphone 300 includes a rear acoustic chamber 312 and a front acoustic chamber 314 defined by shells 313 and 315 of the housing, respectively, on either side of a driver (acoustic transducer) 316. In some examples, a 16 mm diameter driver is used. Other sizes and types of acoustic transducers could be used depending, for example, on the desired frequency response of the earphone. The driver 316 separates the front and rear acoustic chambers 314 and 312. The front chamber 314 does not have a pressure equalization port to connect the chamber 314 directly to an environment external to the earphone.

A port 319 acoustically couples the front chamber 314 and the rear acoustic chamber 312. The port 319 serves to relieve air pressure that could be built up within the ear canal and front chamber 314 during over pressure events (e.g. when the earphone 300 is inserted into the ear). As discussed above, that pressure is then released into the environment through a reactive port from the rear chamber 314. The port 319 preferably has the same dimensions and characteristics that were mentioned above. The rear chamber 312 is sealed around the back side of the driver 316 by the shell 313 except that the rear chamber 312 includes one or both of a reactive element, such as a port (also referred to as a mass port), and a resistive element, which may also be formed as a port (not shown in this sectional view). The reactive element and the resistive element acoustically couple the rear acoustic chamber 312 with an environment external to the earphone. The reactive element and the resistive element preferably have the same dimensions and characteristics that were mentioned above. The front chamber 314 includes a nozzle and an ear tip (not shown in this sectional view) that couple the front chamber 314 to the user's ear (not shown).

A number of implementations have been described. Nevertheless, it will be understood that additional modifications may be made without departing from the scope of the inventive concepts described herein, and, accordingly, other embodiments are within the scope of the following claims.

What is claimed is:

1. An active noise reducing (ANR) earphone, comprising:

a first acoustic chamber including one or more of a reactive element and a resistive element for acoustically coupling the first acoustic chamber with an environment external to the earphone;

an acoustic transducer;

a second acoustic chamber separated from the first acoustic chamber by the acoustic transducer;

a housing to support the earphone from the concha of a wearer's ear and including a nozzle to extend the second acoustic chamber at least to an entrance of an ear canal of the wearer's ear;

ANR circuitry coupled to the acoustic transducer; and a port internal to the earphone that directly acoustically couples the first and second acoustic chambers.

2. The earphone of claim 1, wherein there is only a single opening in the second chamber, besides an entrance to the port, which acoustically couples the second chamber to the ear canal of the wearer's ear.

3. The earphone of claim 1, wherein the second chamber does not have a pressure equalization port to connect the second chamber to the environment external to the earphone.

4. The earphone of claim 1 in which the first acoustic chamber has a volume between about 0.1 $cm^3$ to about 3 $cm^3$.

5. The earphone of claim 1 in which the second acoustic chamber has a volume between about 0.05 $cm^3$ to about 3 $cm^3$.

6. The earphone of claim 1 in which the reactive element has an acoustic absolute value impedance in the range of from about $$3\times10^7\frac{\text{kg}}{m^4\times\text{sec}}$$

to about $$6\times10^8\frac{\text{kg}}{m^4\times\text{sec}}$$

at 1 kHz.

7. The earphone of claim 1 in which the resistive element has a specific acoustic impedance in the range of from about $$3\times10^7\frac{\text{kg}}{m^4\times\text{sec}}$$

to about $$6\times10^8\frac{\text{kg}}{m^4\times\text{sec}}.$$

8. The earphone of claim 1 in which the port has a diameter in the range of from about 0.25 mm to about 3 mm.

9. The earphone of claim 8 in which the port has a diameter of about 0.5 mm.

10. The earphone of claim 1 in which the port has a length in the range of from about 0.25 mm to about 10 mm.

11. The earphone of claim 10 in which the port has a length of about 1 mm.

12. The earphone of claim 1 in which the port has an absolute value acoustic impedance in the range of from about $$1\times10^7\frac{\text{kg}}{m^4\times\text{sec}}$$

to about $$3\times10^8\frac{\text{kg}}{m^4\times\text{sec}}$$

at 1 kHz.

13. A pair of earphones according to claim 1.

14. An active noise reducing (ANR) earphone, comprising:

a first acoustic chamber including one or more of a reactive element and a resistive element for acoustically coupling the first acoustic chamber with an environment external to the earphone;

an acoustic transducer;

a second acoustic chamber separated from the first acoustic chamber by the acoustic transducer and including a nozzle extending the second acoustic chamber to at least an entrance of the wearer's ear;

ANR circuitry coupled to the acoustic transducer; and a port internal to the earphone that directly acoustically couples the first and second acoustic chambers, wherein there is only a single opening in the second chamber, besides an entrance to the port, which acoustically couples the second chamber to an ear canal of a wearer's ear.

15. The apparatus of claim 14, wherein the second chamber does not have a pressure equalization port which connects the second chamber to the environment external to the earphone.

16. The earphone of claim 14 in which the first acoustic chamber has a volume between about 0.1 $cm^3$ to about 3 $cm^3$.

17. The earphone of claim 14 in which the second acoustic chamber has a volume between about 0.05 $cm^3$ to about 3 $cm^3$.

18. The earphone of claim 14 in which the reactive element has an absolute value acoustic impedance in the range of from about $$3\times10^7\frac{\text{kg}}{m^4\times\text{sec}}$$

to about $$6\times10^8\frac{\text{kg}}{m^4\times\text{sec}}$$

at 1 kHz.

19. The earphone of claim 14 in which the resistive element has a specific acoustic impedance in the range of from about $$3\times10^7\frac{\text{kg}}{m^4\times\text{sec}}$$

to about $$6\times10^8\frac{\text{kg}}{m^4\times\text{sec}}.$$

20. The earphone of claim 14 in which the port has a diameter in the range of from about 0.25 mm to about 3 mm.

21. The earphone of claim 20 in which the port has a diameter of about 0.5 mm.

22. The earphone of claim 14 in which the port has a length in the range of from about 0.25 mm to about 10 mm.

23. The earphone of claim 22 in which the port has a length of about 1 mm.

24. The earphone of claim 14 in which the port has an absolute value acoustic impedance in the range of from about $$1\times10^{7}\frac{\mathrm{kg}}{m^{4}\times\mathrm{sec}}$$

to about $$3\times10^{8}\frac{\mathrm{kg}}{m^{4}\times\mathrm{sec}}$$

at 1 kHz.

25. A pair of earphones according to claim 14.

* * * * *